US009181002B2

(12) United States Patent
Peñalver García

(10) Patent No.: US 9,181,002 B2
(45) Date of Patent: Nov. 10, 2015

(54) REVARNISHING HEAD FOR LIDS OF A ROUNDED SHAPE

(75) Inventor: José Peñalver García, Molina de Segura (ES)

(73) Assignee: Industrias Penalver, S.L., Molina de Segura (Murcia) (ES)

( * ) Notice: Subject to any disclaimer, the term of this patent is extended or adjusted under 35 U.S.C. 154(b) by 164 days.

(21) Appl. No.: 13/994,921

(22) PCT Filed: May 26, 2011

(86) PCT No.: PCT/ES2011/070383

§ 371 (c)(1),
(2), (4) Date: Aug. 29, 2013

(87) PCT Pub. No.: WO2012/080538

PCT Pub. Date: Jun. 21, 2012

(65) Prior Publication Data

US 2013/0333614 A1 Dec. 19, 2013

(30) Foreign Application Priority Data

Dec. 17, 2010 (ES) ..... 201031868

(51) Int. Cl.
*B05B 13/06* (2006.01)
*B65D 43/00* (2006.01)
*B05B 13/02* (2006.01)
(Continued)

(52) U.S. Cl.
CPC ..... *B65D 43/00* (2013.01); *B05B 13/0221* (2013.01); *B05B 13/0421* (2013.01); *B05C 5/0216* (2013.01)

(58) Field of Classification Search
USPC ..... 118/306, 318, 313–315, 324, 62, 63, 118/305; 413/19, 61; 427/236
See application file for complete search history.

(56) References Cited

U.S. PATENT DOCUMENTS 6,165,266 A * 12/2000 Garcia ..... 118/305
6,490,969 B2 * 12/2002 Aichele ..... 101/37
6,684,723 B1 2/2004 Stöckle
(Continued)

FOREIGN PATENT DOCUMENTS

EP 0 933 134 8/1999
EP 1 834 706 9/2007
(Continued)

OTHER PUBLICATIONS

International Search Report issued Oct. 25, 2011 in International (PCT) Application No. PCT/ES2011/070383.

*Primary Examiner* — Yewebdar Tadesse
(74) *Attorney, Agent, or Firm* — Wenderoth, Lind & Ponack, L.L.P.

(57) ABSTRACT

A header intended to be installed in a horizontal platform in the form of a working table of a recoating machine to repair lids, lids, comprises a copying device (1) sustained by a cam support (5), joined in turn to an upper support (4), the copying device having a copying cam body (3) solidary to the cam support (5), the static solidary set of these three elements (3-4-5) being coupled around the main rotary shaft (10), to which lower extremity a drum (18) is affixed dragging the copying device with its rotary movement. The copying device has, among its elements, roller followers (25) driven in grooves (3') located in the copying cam body 3, the copying device (1) also having coating guns (17).

17 Claims, 10 Drawing Sheets

(51) Int. Cl.
*B05B 13/04* (2006.01)
*B05C 5/02* (2006.01)

(56) References Cited

U.S. PATENT DOCUMENTS

| | | | |
|---|---|---|---|
| 7,622,002 | B2 | 11/2009 | McEldowney et al. |
| 7,927,667 | B2 | 4/2011 | McEldowney et al. |
| 2001/0025573 | A1 | 10/2001 | Aichele |
| 2007/0218196 | A1 | 9/2007 | McEldowney et al. |
| 2010/0021629 | A1 | 1/2010 | McEldowney et al. |

FOREIGN PATENT DOCUMENTS

| | | |
|---|---|---|
| ES | 1 049 529 | 12/2001 |
| ES | 2 272 367 | 5/2007 |
| GB | 2 269 331 | 2/1994 |
| WO | 01/08832 | 2/2001 |

* cited by examiner

REVARNISHING HEAD FOR LIDS OF A ROUNDED SHAPE

OBJECT OF THE INVENTION

The present invention, as expressed in the wording of this specification, relates to a coating head for lids of a rounded shape intended to recoat lids of all types of shapes.

The head is capable of repairing easy-open lids of a circular shape (from 52.5 to 153 mm) and other shapes, with a production of about six hundred lids per minute in single line revarnishing machines and one thousand and two hundred lids per minute in double line revarnishing machines.

Therefore, the invention is based in a single revarnishing set, adapted to circular shapes and other lid shapes, integrated in a single unit with quick and easy exchangeability between formats, requiring minimum maintenance, being highly productive, being easily adaptable to existing revarnishing machines in the market, owned by the same holder of the present invention, and offering a broad range of possibilities to carry out the repair of the lid by means of the varnishing operation in its different areas, incision and rivet, as well as the partial or full varnishing by one side or the other. This device is designed for its easy implantation, both in old and new machines, regardless if they have one/two lines of production.

The demand of the market has forced manufacturers to produce lids depending on the needs of the market, which means they would have to manufacture lid with different shapes during the course of the year, which is why this type of head is completely optimal for their needs because one single unit is able to repair different lid shapes, always using the same revarnishing head.

BACKGROUND OF THE INVENTION

There are currently different types of revarnishing machines capable of repairing easy-open lids existing in the market; however, they are focused and limited, in general terms, to lids of a circular shape, which is why they are not versatile to the rest of lid shapes existing in the market.

The implantation of the new head is intended to provide a unit suitable for the revarnishing of lids of all types of shapes.

DESCRIPTION OF THE INVENTION

With the purpose of achieving the objectives and preventing the inconveniences mentioned in the previous sections, the invention proposes a Revarnishing head for lids of a rounded shape that comprises a cubic structure while having all the actuation means necessary to carry out the coating operation through at least one application gun. It is basically constituted by two mechanisms: one recoating mechanism and one elevation mechanism.

The revarnishing mechanism is the only one that interacts with the lid because it is in charge of distributing the varnish on the surface to be repaired, while the elevation mechanism allows adjusting the height of the head and makes easier the cleaning and maintenance thereof.

The head set is fastened to the varnishing table of the unit by means of an anchoring template provided with a slide for its adjustment. Once located in its working position, the guns aim at the center of the varnishing table, along the entire length of which there is a chain of fins actuated by an intermittent rotary indexer. Thanks to this chain, the lids are taken one by one to the revarnishing station and then evacuated towards the drying oven.

The head is actuated by a servomotor by means of a belt-pulley transmission that provides movement to a main shaft to which a two-way rotary joint is coupled for the supply of varnishing and pressurized air into the unit.

The main shaft rotates together with the drum which houses at least one gun to carry out this process in its interior.

The head has four helical grooves on its edge to refrigerate and isolate the mechanism during the varnishing process. The copying system is carried out through the cam-follower method.

The elevation mechanism is based on the vertical displacement of the copying head with respect to the varnishing table by means of a pneumatic cylinder located in the rear part of the device.

This mechanism also adjusts the height at which the varnishing guns remain with respect to the varnishing table.

It is characterized in that it comprises a copying device held by a cam support, joined in turn to an upper support, the copying device having a copying cam body joint to the cam support, the static joint set of these three elements being coupled around a main rotary shaft, to which extremity a drum dragging the copying device in its rotary movements is affixed.

This copying device has, among its elements, roller followers driven through grooves located in the copying cam body, the copying device also having varnishing guns.

The copying device is characterized in that it comprises copying shafts, each one of which is coupled with free rotation in correspondence to the drifting of the drum, also comprising a radial arm joint to an upper end section of the copying shaft, while the free extremity of said radial arm is connected to the roller follower.

The lower end section of the copying shaft is characterized in that it holds a lower radial arm that supports the respective varnishing gun.

The head is also characterized in that the roller follower and the varnishing gun are both arranged in the same direction.

Each copying shaft is characterized in that it is coupled in the corresponding drifting with interposition of upper and lower friction sleeves, both of them having annular ribs that make contact against the extremities of said drifting.

Another characteristic of the invention is that a fastening nut is coupled to the copying shaft in correspondence with a threading established between the upper copying arm and the annular rib of the upper friction sleeve.

Another particularity of the invention is that the copying shaft incorporates a mane put between the lower arm of the varnishing gun and the annular rib of the lower friction sleeve, said lower arm being axially affixed by its lower part by means of a washer screwed to the copying shaft.

The head is also characterized in that the static joint set, formed by the cam body, upper support and cam support, is coupled around the main shaft by means of an upper bearing and a lower bearing, both separated by a internal sleeve and an external sleeve.

Another point to keep in mind in the invention is that in an upper part of the main shaft that protrudes above the upper support, a driven pulley is joined by means of a conical sleeve, being the driven pulley linked to a motor pulley that is connected to a servomotor associated to a motor-carrier support joined to the upper support and the head-carrier support.

The servomotor is affixed to the motor-carrier support by means of an adjustable mobile base movable perpendicularly in the direction of the servomotor, its position being fixed by means of adjustment screws coupled to the support and on which the adjustable mobile base makes contact.

Another aspect to highlight in the invention is that in the upper extremity of the main shaft a flange is affixed as the connection between said shaft and a rotary joint to supply air and varnish to the varnishing guns, the main shaft having an axial perforation for said purpose that goes across the flange and also a varnishing distributor affixed in the interior of the drum.

The groove of the cam body is characterized in that it comprises an eccentric groove composed by three cam profiles: an upper profile that acts as a cam, an intermediate profile that acts as a counter-cam, and a lower profile that also acts as a cam, said eccentric groove being supplemented by three rollers of the follower, so the upper and lower rollers rest on the internal face of the upper and lower cam profiles, while the intermediate roller is in contact with the external face of the intermediate cam profile.

The head is also characterized in that it comprises a fixed support wherein the static joint set, formed by the copying cam, upper support and cam support and all other elements associated to said static joint set, is guided vertically, said fixed support making up the connection of the head with a varnishing table of a varnishing machine.

The vertical displacement of the aforementioned static joint set and all other elements associated thereof is mobilized by means of a linear actuator joined to the fixed support.

Another detail of the invention to keep in mind is that the guided coupling between the fixed support and the static joint set and all other elements associated thereof comprises guides screwed to the head-carrier support in combination with linear bearings located in frontal housings of the fixed support.

The vertical descent of the static solidary set and all other elements associated thereof is limited by a screw located on the fixed support.

It should be noted that the invention incorporates a revolving body that covers and seals all the mobile elements, said surrounding body being affixed to the cam support.

Another particularity of the invention is that the fixed support is associated to the varnishing table by means of an adjustable support provided with an adjustment slide.

Next, in order to facilitate a better comprehension of this specification and being an integral part thereof figures representing the object of the invention in an illustrative rather than limitative manner haven been attached.

DESCRIPTION OF THE PREFERRED EMBODIMENT

Figure 1:
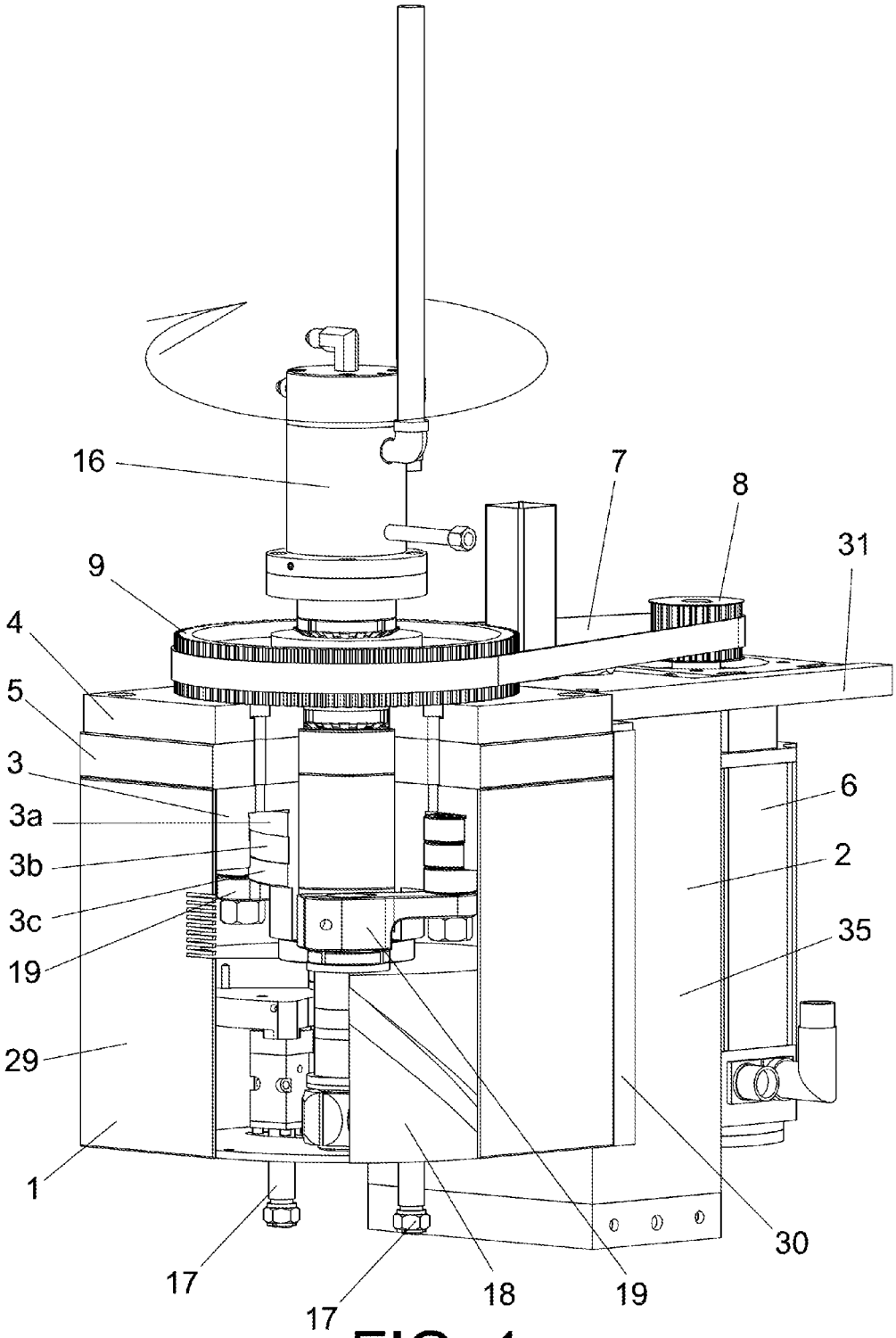
FIG. 1.—Represents a general view of the revarnishing head for lids of a round shape, object of the invention. The main elements are shown, as well as the rotary direction of the transmission providing it with movement.
Figure 2:
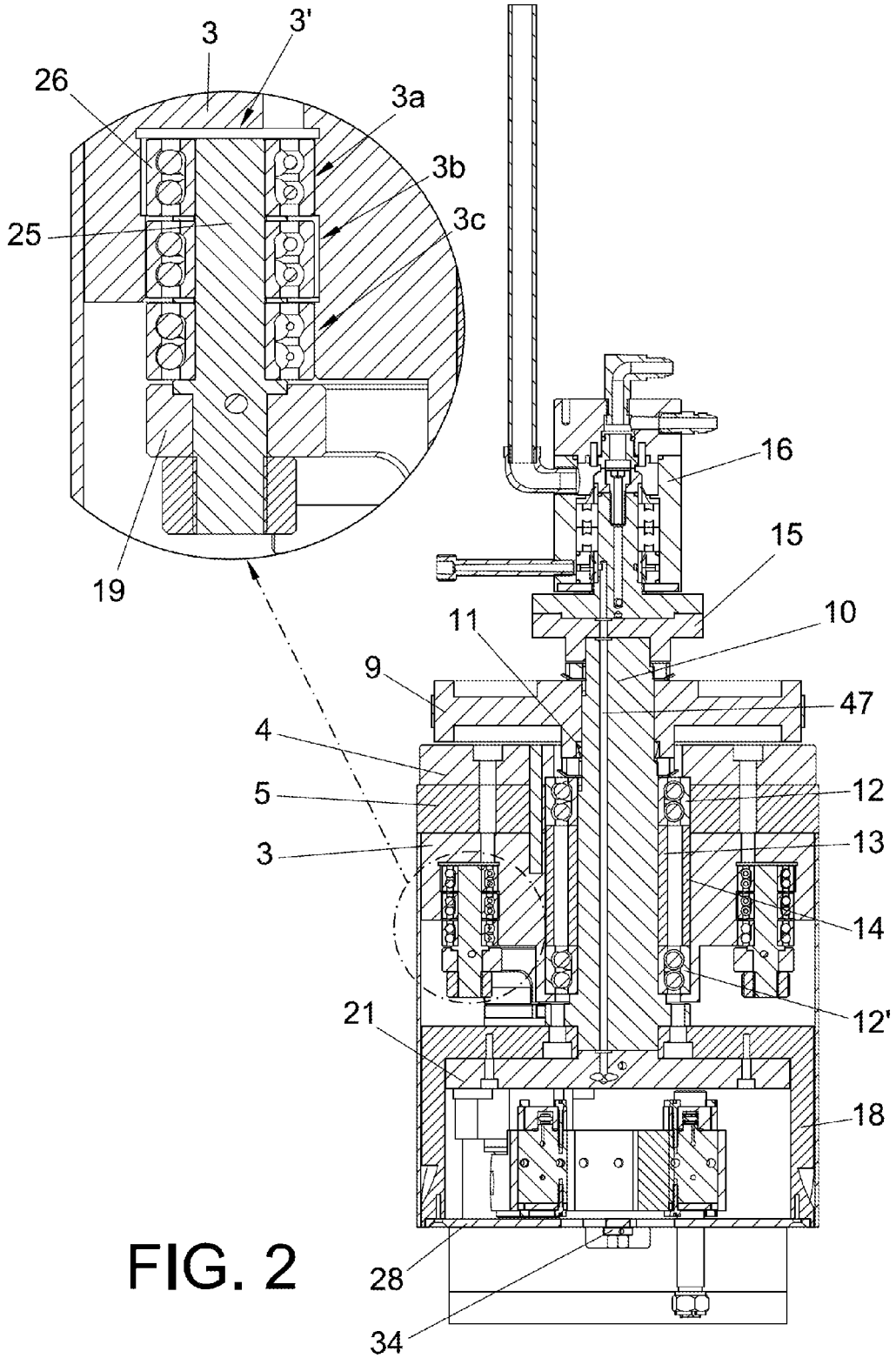
FIG. 2.—Shows a transverse sectioned view of the revarnishing head with all the most representative elements and a detail thereof showing the triple roller copying cam and follower system coupled on an eccentric grove more clearly.
Figure 3:
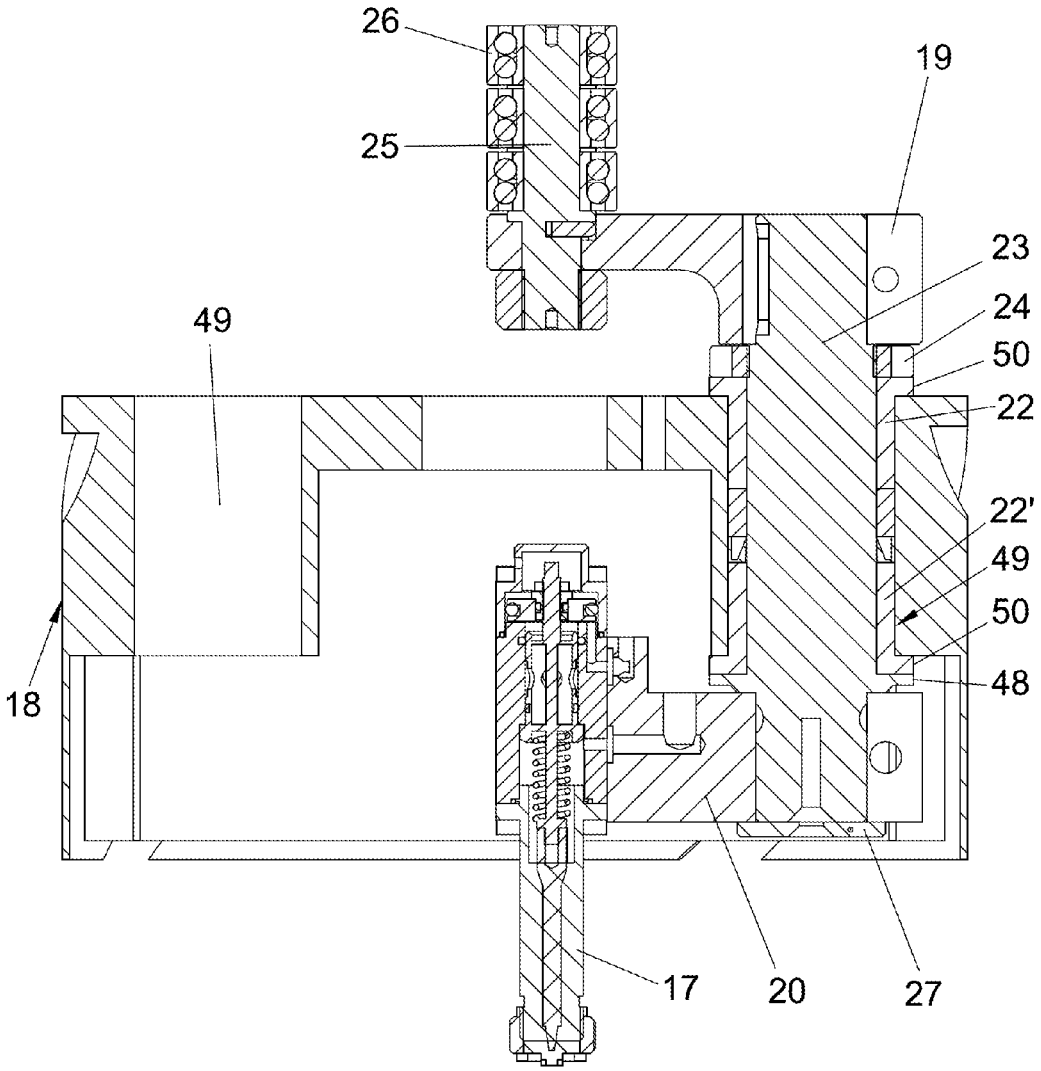
FIG. 3.—Represents a transverse section showing the different elements integrating the copying shaft, from the follower to the varnishing gun.
Figure 4A:
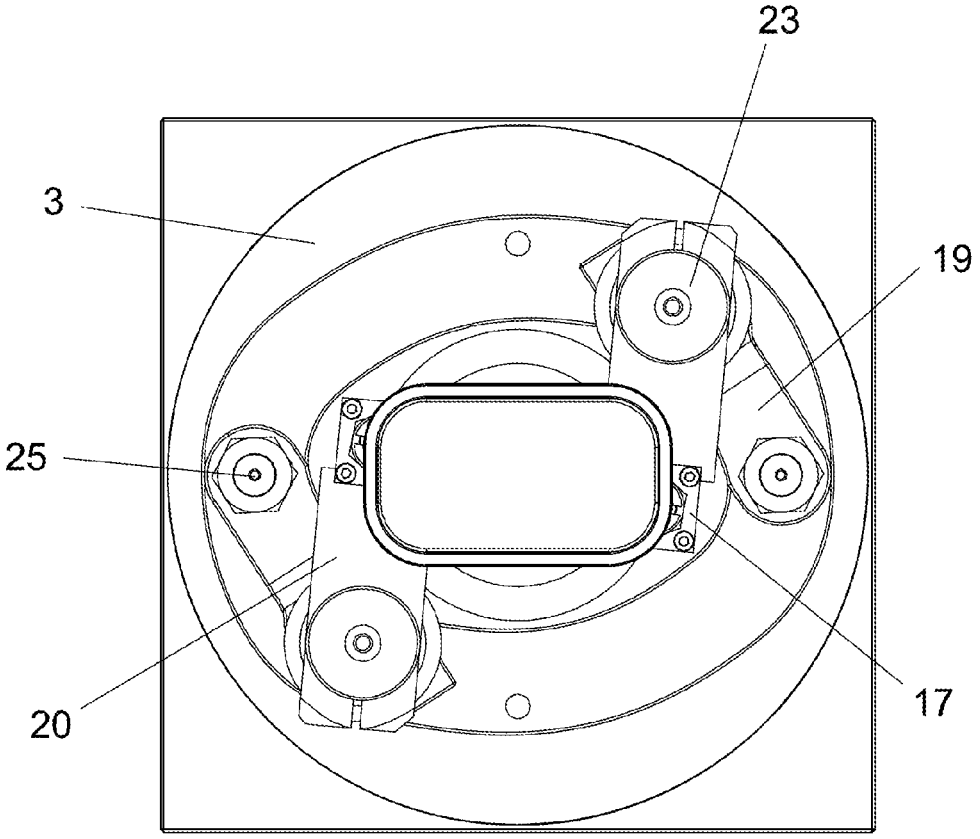
FIGS. 4*a* and 4*b*.—Show a plant view of the revarnishing process of a lid by means of two steps, where the different positions of the follower and the gun along the cam profile are shown.
Figure 4B:
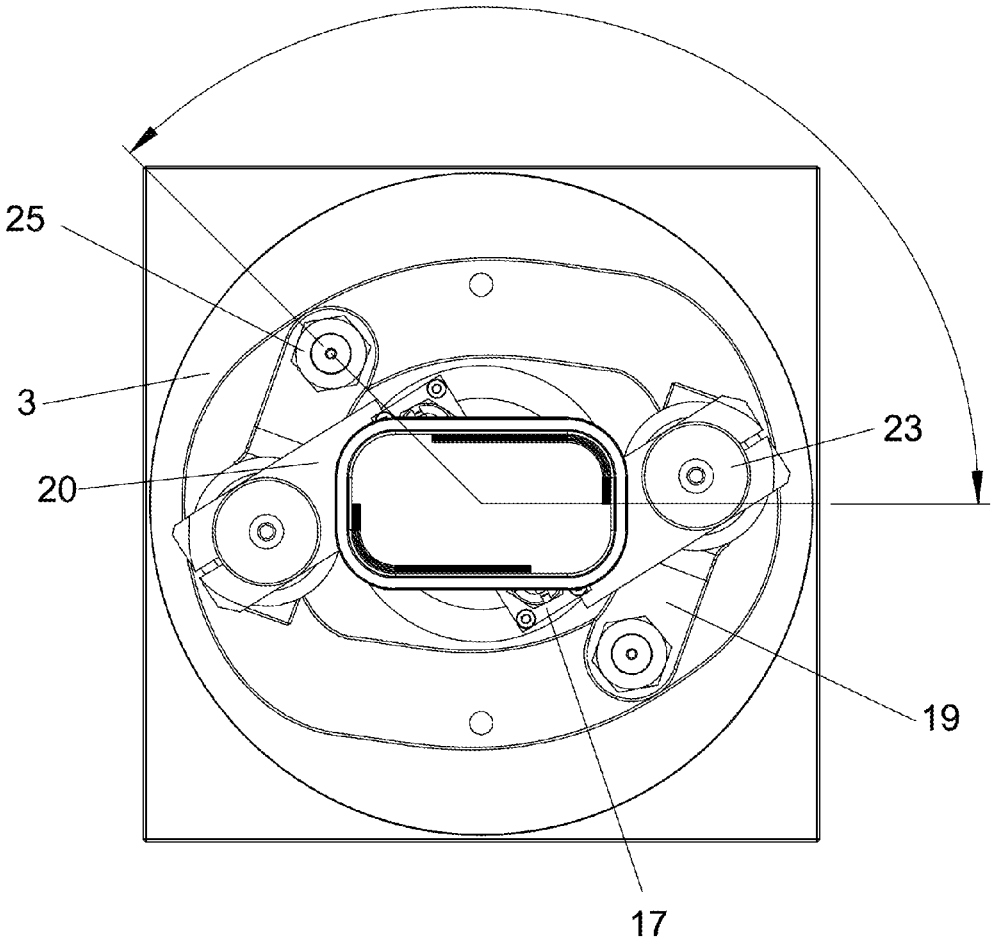
Figure 5:
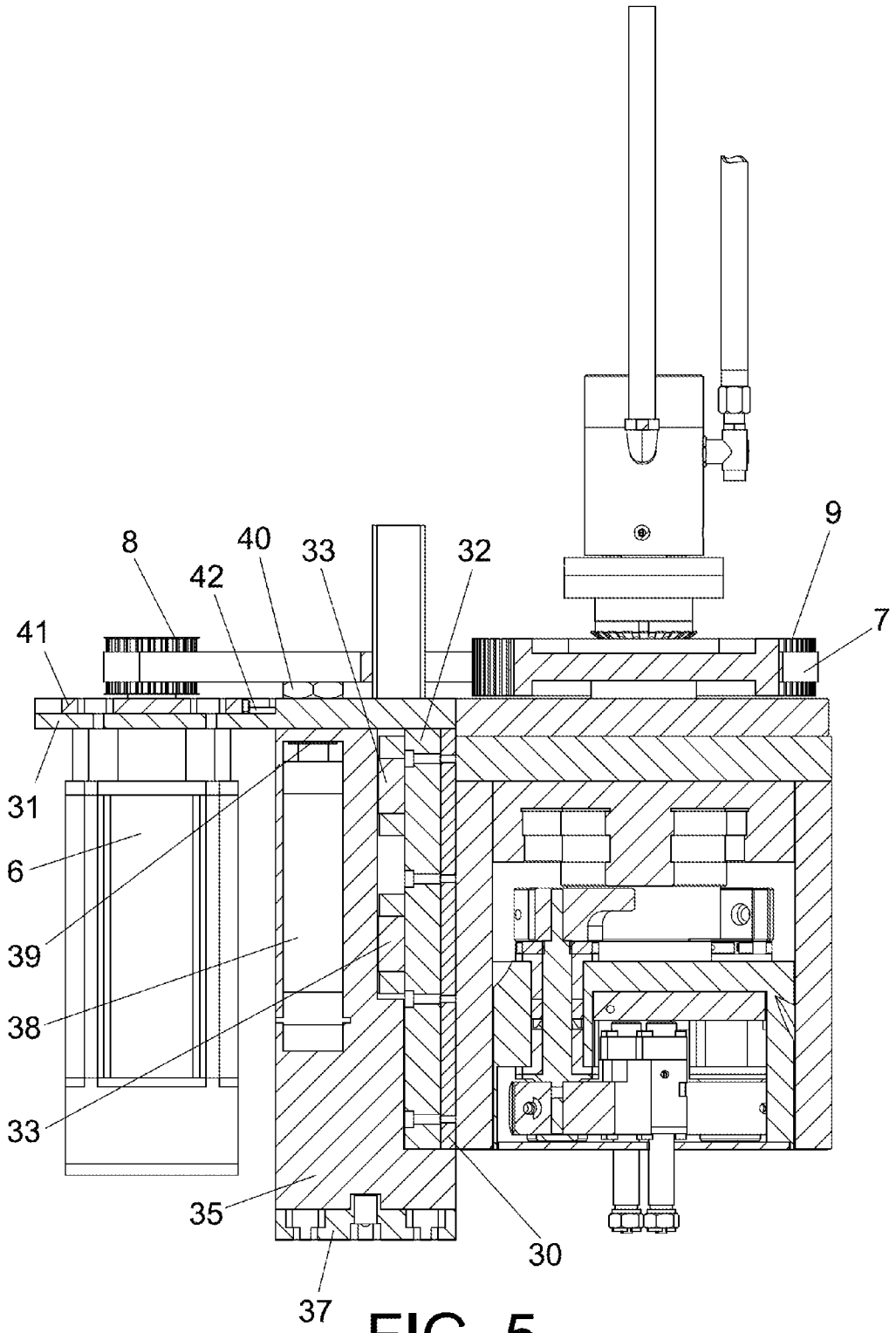
FIG. 5.—Represents a lateral section of the revarnishing head, wherein the most representative elements of the elevation mechanism have been highlighted.
Figure 6:
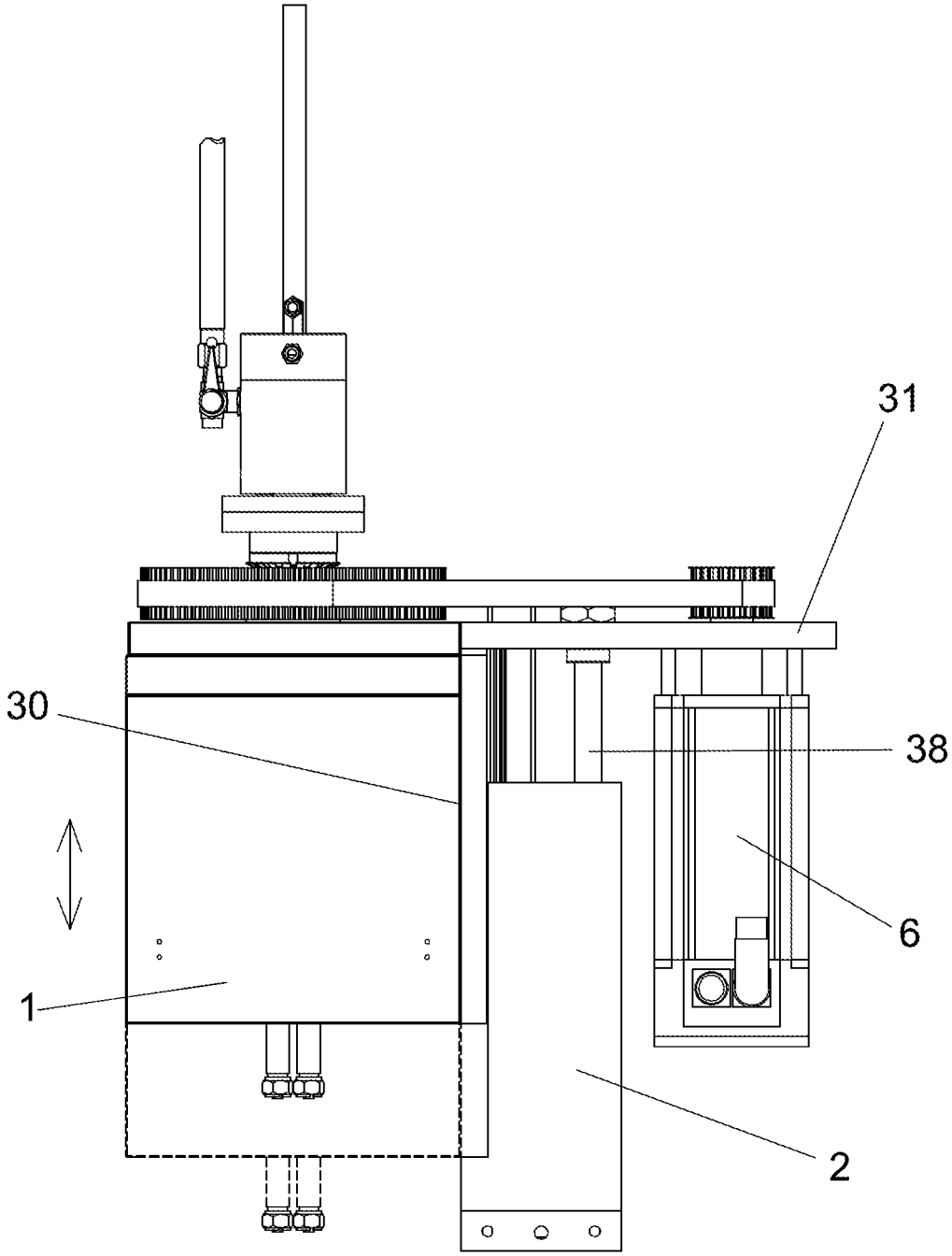
FIG. 6.—Shows a lateral elevational view of one of the height positions adopted by the copying device when the elevation device is actuated.
Figure 7:
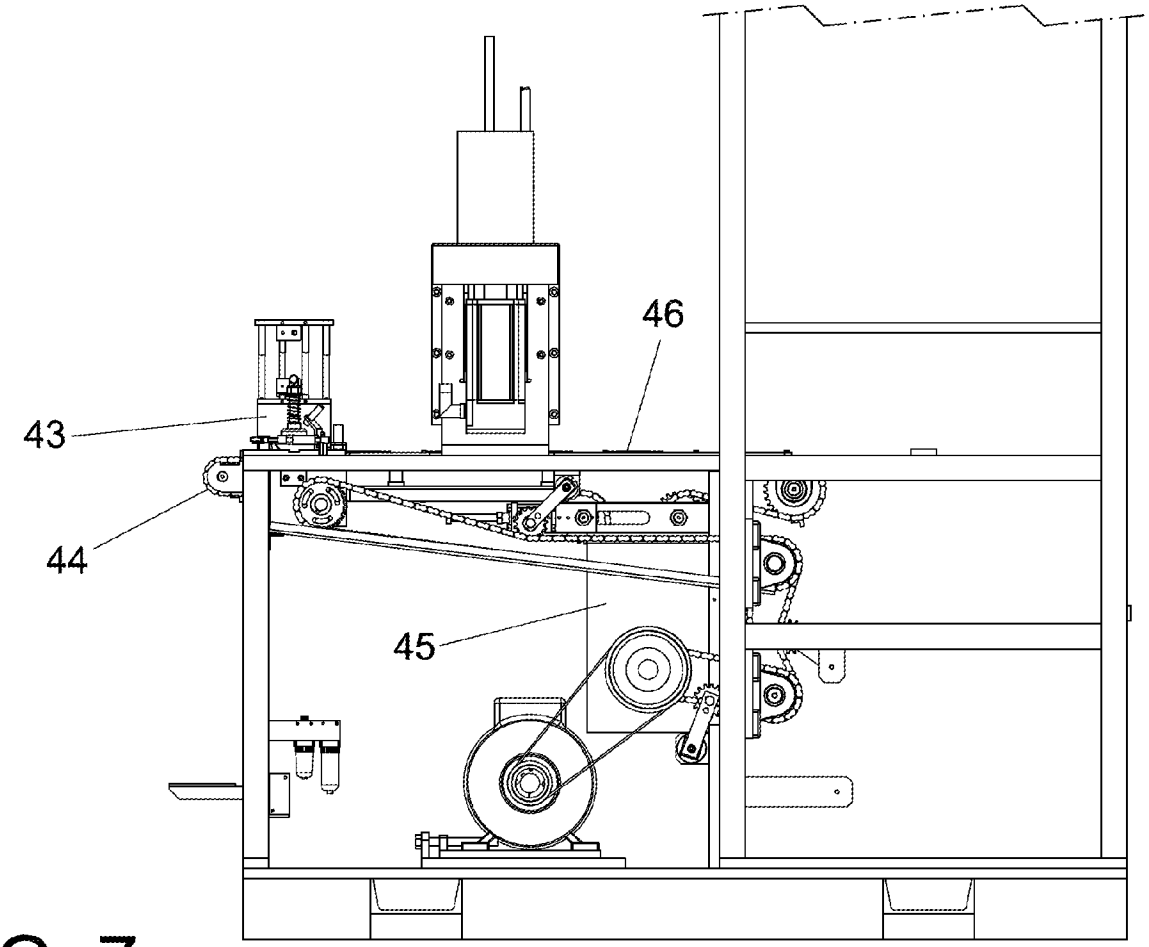
FIG. 7.—Represents a lateral elevational view showing the implantation of the varnishing head on a revarnishing machine.
Figure 8:
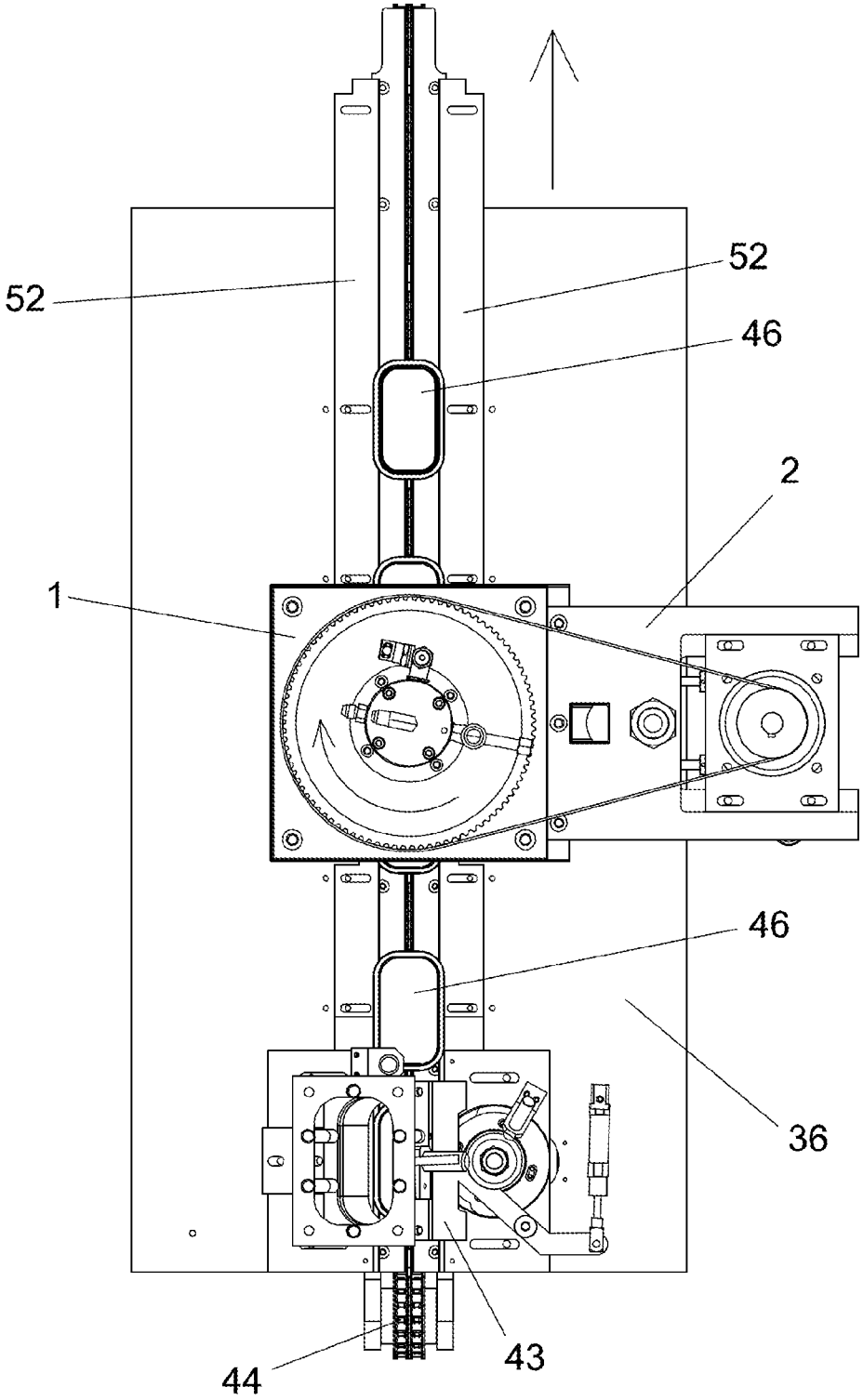
FIG. 8.—Shows, through a plant view, the implantation of the revarnishing head on the one line revarnishing machine.
Figure 9:
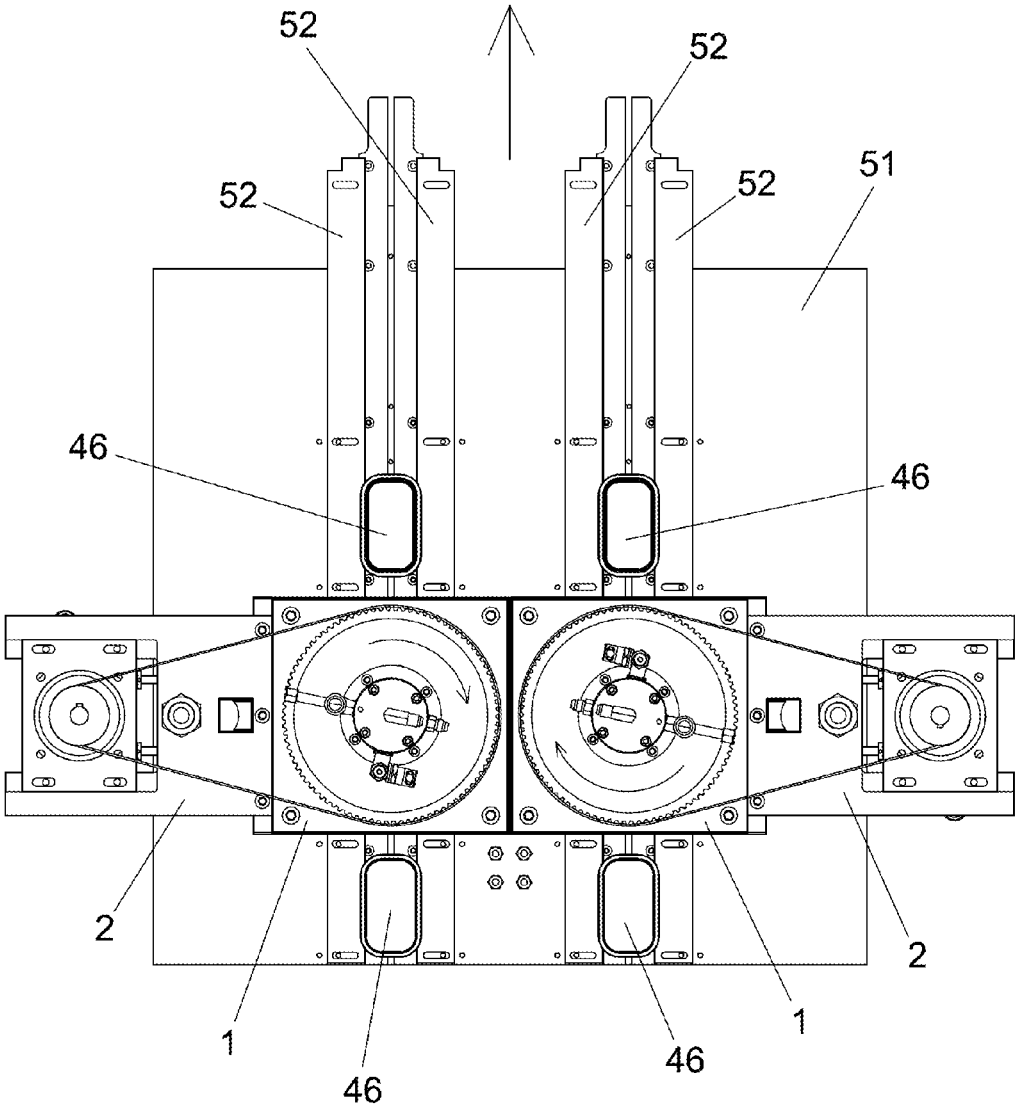
FIG. 9.—Shows, through a plant view, the implantation of the revarnishing head on the two line revarnishing machine.

Taking into account the numeration adopted in the figures, the invention relates to a revarnishing head for lids of a rounded shape that may be integrated to existing machines with one or two lines of production, said head being therefore adaptable to any lid shape by means of a simple format change consisting of the replacement of the copying cam body 3 for another analogous cam body in the new format to be installed in the head unit.

The head incorporates a copying device 1 sustained on two fixed prismatic bodies arranged in the upper area of the head; one called upper support 4, which acts as the closure of the mechanism, and another attached to this one on its lower face, called cam support 5, since it serves as the affixing means for the copying cam 3, so these three elements, screwed and positioned between each other by means of a cylindrical pin, form a single fixed body set 3-4-5.

The copying device 1 is actuated by means of a servomotor 6 through a transmission composed by a belt 7, a motor pulley 8 and a driven pulley 9. The driven pulley 9 rotates in a joint manner with a main rotary shaft 10 due to the coupling of a conical fastening sleeve 11 located between the internal diameter of the pulley 9 and the external diameter of the aforementioned rotary shaft 10. This rotary shaft 10 rotates in a joint manner on the internal tracks of two angular contact ball bearings 12, coupled to two pockets located between the bodies 3-4-5.

In order to carry out an exact adjustment in the coupling of the upper support 4 and the cam support 5, two separating sleeves have been included, an internal one 13 and an external 14, between the ball bearings, upper 12 and lower 12', located on the internal and external track, respectively, so this arrangement allows an appropriate tightening between both bodies, taking into account the particularity that the housing that houses the upper ball bearing 12 is arranged on the supports 4-5.

On the upper extremity of the main rotary shaft 10 rests a flange 15, screwed to said shaft, which serves as the connection between the shaft and the two-way rotary joint 16. Said rotary joint 16 is used to supply air and varnish to the varnishing guns 17, the main rotary shaft 10 having an axial perforation 47 for said purpose.

A duralumin drum 18 of a cylindrical shape that serves as support for the copying arms 19 of the roller followers 25 and the arms of the varnishing guns 20, as well as for a varnishing distributor 21, designed for said purpose, is screwed on the lower extremity of the main rotary shaft.

The drum 18 has two driftings 49 with an angular offset of 180°, where two friction sleeves are located on each one of them, an upper friction sleeve 22 and a lower friction sleeve 22', to house the copying shaft 23. On the upper end of the copying shaft 23 a fastening nut is threaded to prevent the axial displacement, and the keyed copying arm 19 houses the roller follower 25, so it rotates around the main rotary shaft 10 and oscillates on the copying shaft 23 at the same time while the roller follower 25 moves forward through the groove 3' of the copying cam body 3.

This is a copying system based on a roller cam-follower mechanism 3-25, but with several very interesting particularities that are indicated below.

Therefore, the cam body 3 designed is a fixed element with the groove 3' inside, where the roller follower 25 traverses the profile of the groove 3'. The follower 25 is a triple roller 26 follower composed by three angular contact bearings. In order to ensure a continuous contact of the cam-follower body 3-25, the groove 3' with an eccentric structure has been designed, said groove is composed by three cam profiles: an upper profile 3*a* that acts as a cam, an intermediate profile 3*b* that acts as a counter-cam, and lastly a lower profile 3*c* that also acts as a cam.

The coupling of the roller follower 25 to each one of the profiles is carried out in such away that it forces the bearings 26 (rollers) to press against three opposing points of contact at all times, in such a way that two of them rest on the internal profile of the cam 3*a*-3*c*, while the other one makes contact with the external profile of the intermediate cam profile 3*b*.

During the design of the cam body 3 a groove has been mechanized, said groove being slightly greater than the diameter of the roller 26, where the center thereof is on the primitive line of said groove.

With this new design, we can verify whether the roller follower 25 is carrying out an exact and precise copying on the designed cam profiles 3*a*-3*b*-3*c* when making contact with a homogenous pressure along the entire course.

The results obtained by means of this system are highly satisfactory because, by means of a single cam body 3 and a triple roller 26 follower 25, a triple contact cam-follower copying system has been obtained, free from slacks and tightening and guaranteeing a suitable and precise copying of the profile, thus ensuring a longer useful life of the rollers 26.

Continuing with the description of the head of the invention, the arm of the gun 20 is coupled on the lower end of the copying shaft 23, said arm of the gun 20, which is housed between a mane 48 of the copying shaft 23 and a washer 27, screwed on the lower end thereof. As the copying arm 19, the arm of the gun 20 rotates around the main rotary shaft 10 with a continuous movement and it also oscillates on the copying shaft 23, describing the movement transmitted by the roller follower 25 when it transverses the cam profile through the groove 3'.

In the opposite end of the arm 20 the varnishing gun 17 is coupled, which is affixed by means of two screws and receives air for its operation and varnishing to carry out the repairing process of the lid through two supply ducts. The air and varnish ducts begin on the rotary joint 16 towards the main rotary shaft 10 and are connected to the distributor 21 at this point.

Thereafter, by means of two flexible ducts, the fluids are sent towards the arm of the gun 20 where, through two holes, the supply of air and varnishing is taken towards two valves presented by the varnishing gun 17. In order to prevent the projections of particles on the interior of the head during the revarnishing operation, the device has a closure lid 28 in the lower area that is coupled to the drum 18. Likewise, all the mobile elements of the head are covered by a prismatic-shaped body 29 that seals the entire mechanism and is affixed to the device by means of screws tying it to the fixed cam support 5.

It should be noted that the copying device mentioned herein is practically exempt from maintenance in terms of lubrication, because the bearings 12-12' incorporated are lubricated for life.

The elevation device 2 is basically arranged on three elements: two of them are mobile and one of them is fixed. The two mobile elements are screwed and positioned between each other at 90°, in such a way that one of them remains in a vertical arrangement, the so-called head-carrier support 30, while the other, called the motor-carrier support, remains in a horizontal arrangement.

The head-carrier support 30 is screwed to the prismatic body 29 and the cam support 5, in such a way the when the first of them is elevated, it displaces the entire copying device vertically, and at the same time the motor-carrier support 31 is moved because it is screwed thereof. The vertical ascending/descending movement of the head-carrier support 30 is carried out by means of two guides 32, provided with linear bearings 33, and their course is limited by means of a screw 34 located on an L-shaped fixed support 35, so when it descends towards lower positions, it makes contact with the head of the screw 34, preventing the entire copying device 1 from descending towards the surface of the revarnishing table 36-51 in this manner.

The elevation device 2 moves around the fixed support 35 provided, in its lower base, with an adjustable support 37 that affixes the entire revarnishing head to the table 36-51.

On the frontal surface of the fixed support 35 two pockets have been mechanized for the coupling of four linear bearings 33, which are affixed by means of screws to said body, and two guides 32, screwed to the head-carrier support 30, slide vertically on said linear bearings, thus allowing the mobility of said support.

In order to execute the elevation of the entire copying device, a linear actuator 38 such as a compact pneumatic cylinder has been included, that is screwed and built-in a housing designed for said purpose, being said housing located on the rear surface of the fixed support 35. When the aforementioned cylinder 38 is provided with air pressure, its piston rod pushes the motor-carrier support 31 displacing the head-carrier support 30 vertically, thus elevating the entire revarnishing head.

For the cylinder 38 pushes the motor-carrier support 31 in a homogenous manner, a sleeve 39 with a mane and a nut 40 threaded on the tip of the piston rod of said cylinder 38 has been provided, so both elements press against the motor-carrier support 31 on both sides in the form of a sandwich.

The motor-carrier support 31 includes inside an adjustable mobile base 41 provided with a slide, to which the servomotor 6 is nailed. By means of two adjustment screws 42 threaded on the motor-carrier support 31 and pressing against the lateral side of the adjustable mobile base 41, the belt engaging the motor pulley 8 and driven pulley 9, located on the servomotor 6 and main rotary shaft, respectively, can be provided with the optimal tension.

The copying device 1 and the elevation device 2 are implemented in the revarnishing machine and located in the central part of the varnishing table 36-51. Both devices 1-2 are fastened to the varnishing table 36-51 of the unit by means of the adjustable support 37 provided with a slide for its adjustment. The supply is carried out by means of a tower 43, designed for the correct distribution of lids 46 to the unit. After the lids 46 have been placed on the supply guides 52, a chain of fins 44, actuated by an indexer 45 that coordinates the forward and stop movements, locates the lids 46 one by one in the revarnishing position and, taking advantage of the stopped state of the chain of fins 44 and thanks to the actuation of the varnishing guns 17, the repair of the lid 46 takes place. After this operation is carried out, the chain of fins 44 pushes the lid 46 with its forward movement towards the interior of the drying oven.

The invention claimed is:

1. A revarnishing head for lids of a rounded shape, comprising a copying device (1) sustained by a cam support (5), joined to an upper support (4), the copying device (1) having a copying cam body (3) joint to the cam support (5), a static joint set of the copying cam body (3), the upper support (4) and the cam support (5) being coupled along a rotary shaft (10), to which lower end a drum (18) is affixed, dragging the copying device (1) with a rotary movement, which comprises a roller follower (25) driven in a groove (3') located in the copying cam body (3), the copying device (1) also having varnishing guns (17); likewise, the groove (3') of the copying cam body (3) is an eccentric groove made up by an upper profile (3*a*) that acts as a cam, an intermediate profile (3*b*) that acts as a counter-cam, and a lower profile (3*c*) that also acts as a cam, said eccentric groove (3') being supplemented by an upper roller, an intermediate roller and a lower roller of the roller follower (25), so the upper roller and the lower roller rest on an internal face of the upper profile (3*a*) and of the lower profile (3*c*), while the intermediate roller makes contact with an external face of the intermediate cam profile (3*b*).

2. The revarnishing head for lids of a rounded shape, according to claim 1, wherein the copying device comprises copying shafts (23), each one of which is coupled with free rotation in correspondence to a drifting (49) of the drum (18), also comprising an upper radial arm (19) fixed to an upper end section of a copying shaft (23), while a free extremity of said upper radial arm (19) is joined to the roller follower (25).

3. The revarnishing head for lids of a rounded shape, according to claim 2, wherein a lower end section of the copying shaft (23) sustains a lower radial arm (20) supporting the respective varnishing gun (17).

4. The revarnishing head for lids of a rounded shape, according to claim 2, wherein the roller follower (25) and the varnishing gun (17) are arranged in a same direction.

5. The revarnishing head for lids of a rounded shape, according to claim 2, wherein each copying shaft (23) is coupled to a drifting (49) with interposition of an upper friction sleeve (22) and a lower friction sleeve (22'), which have annular ribs (50) that meet extremities of the drifting (49).

6. The revarnishing head for lids of a rounded shape, according to claim 5, wherein a fastening nut (24) is coupled on the copying shaft (23), in correspondence with a threading established between the upper radial arm (19) and an annular rib (50) of the upper friction sleeve (22).

7. The revarnishing head for lids of a rounded shape, according to claim 5, wherein the copying shaft (23) incorporates a mane (48) between a lower arm (20) of the varnishing gun and the annular rib (50) of the lower friction sleeve (22'), said lower arm (20) being axially affixed by a lower part by means of a washer (27) screwed to the copying shaft (23).

8. The revarnishing head for lids of a rounded shape, according to claim 1, wherein the static joint set formed by the copying cam body (3), the upper support (4) and the cam support (5) is coupled around the rotary shaft (10) by an upper bearing (12) and a lower bearing (12') being separated by an internal sleeve (13) and an external sleeve (14).

9. The revarnishing head for lids of a rounded shape, according to claim 1, wherein in an upper part of the rotary shaft (10) that protrudes above the upper support (4) is joined by a conical sleeve (11), a driven pulley (9) linked to a motor pulley (8) by a belt (7), the belt (7) being connected to a servomotor (6) associated to a motor-carrier support (31) joined to a head-carrier support (30).

10. The revarnishing head for lids of a rounded shape, according to claim 9, wherein the servomotor (6) is affixed to the motor-carrier support (31) by an adjustable mobile base (41), movable perpendicularly in a direction of the servomotor (6), its position being affixed by adjustment screws (42) coupled in the motor-carrier support (31) and on which an adjustable mobile base (41) meets.

11. The revarnishing head for lids of a rounded shape, according to claim 9, wherein a guided coupling between the fixed support (35) and the static joint set formed by the copying cam body (3), the upper support (4) and the cam support (5) comprises guides (32) screwed to the head-carrier support (30) in combination with linear bearings (33), located in frontal housings of the fixed support (35).

12. The revarnishing head for lids of a rounded shape, according to claim 11, wherein a vertical descent of the static joint set formed by the copying cam body (3), the upper support (4) and the cam support (5) is limited by a screw (34) located on the fixed support (35).

13. The revarnishing head for lids of a rounded shape, according to claim 1, wherein on the upper end of the rotary shaft (10) a flange (15) is affixed as a connection between said rotary shaft (10) and a rotary joint (16) to supply air and varnish to the varnishing guns (17), the rotary shaft (10) having an axial perforation (47) that cuts across the flange (15) and also a varnish distributor (21) affixed in a interior of the drum (18).

14. The revarnishing head for lids of a rounded shape, according to claim 1, further comprising a fixed support (35) wherein the static joint set formed by the copying cam body (3), the upper support (4) and the cam support (5), is guided vertically, said fixed support (35) constituting the connection of a head set with respect to a varnishing table (36-51) of a revarnishing machine.

15. The revarnishing head for lids of a rounded shape, according to claim 14, wherein a vertical displacement of the static joint set formed by the copying cam body (3), the upper support (4) and the cam support (5) is mobilized by a linear actuator (38) joined to the fixed support (35).

16. The revarnishing head for lids of a rounded shape, according to claim 14, wherein the fixed support is associated to a varnishing table (36-51) by an adjustable support (37) provided with an adjustment slide.

17. The revarnishing head for lids of a rounded shape, according to claim 1, wherein the revarnishing head incorporates a prismatic body (29) with a surrounding configuration that covers and seals all mobile elements, said prismatic body (29) being affixed to the cam support (5).

* * * * *